United States Patent [19]

Kramer

[11] Patent Number: 4,503,890

[45] Date of Patent: Mar. 12, 1985

[54] RELEASABLE HEDDLE ROD CONNECTOR

[75] Inventor: Charles F. Kramer, Greenville, S.C.

[73] Assignee: Steel Heddle Mfg. Co., Greenville, S.C.

[21] Appl. No.: 484,542

[22] Filed: Apr. 13, 1983

[51] Int. Cl.[3] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 2,625,958 | 1/1953 | Kaufmann | 139/92 |
| 2,634,762 | 4/1953 | Consoletti | 139/92 |
| 3,901,282 | 8/1975 | Kramer et al. | 139/92 |
| 4,252,153 | 2/1981 | Kaufmann et al. | 139/92 |

FOREIGN PATENT DOCUMENTS

| | | | |
|---|---|---|---|
| 2610311 | 9/1977 | Fed. Rep. of Germany | 139/92 |

*Primary Examiner*—Henry S. Jaudon
*Attorney, Agent, or Firm*—Dority & Manning

[57] ABSTRACT

A rod hook (A) is fixed to a heddle rod (20, 22) by which heddles (24) are supported in the frame (10) with unrestricted mobility. A slidable connecting sleeve (C, D) is carried by frame slats (12, 14) which releasably connects the heddle rod hook (A) to the frame slat for convenient connection and disconnection.

15 Claims, 7 Drawing Figures

RELEASABLE HEDDLE ROD CONNECTOR

BACKGROUND OF THE INVENTION

The invention relates to looms and more particularly to the construction of a heddle frame for a loom and for apparatus for connecting the heddle supporting rod and frame slat of the heddle frame together in a quickly releasable manner.

With the advent of high speed shuttleless looms, there is a need to take the heddle rods out of the heddle frame of certain type looms for drawing-in of the warp threads through the eyes of the heddles. Due to the construction of the loom it is inconvenient to remove the entire harness frame so the heddle rods and heddles supported thereon are removed from the frame. This requires that the heddle frame itself remain in place in the loom and that the heddle rods and heddles are removed individually for rethreading of the warp yarns in the eyes of the heddles.

The heddles and heddle rods are then put on a "dummy" frame at the drawing-in machine while the warp threads are redrawn through the heddle eyes. The "dummy" frame is merely a frame which supports the top and bottom heddle rods a proper distance apart with the heddles sliding freely on the heddle rods so that the heddles may be rethreaded. Once the drawing-in operation is complete, the heddle rods are unsnapped from the "dummy" frames and the heddle rods and heddles supported thereon are taken back to the original heddle frames on the loom and re-installed by means of appropriate heddle rod hooks.

The heddle rod is normally attached to the frame slat by means of a heddle rod hook which may be in the form of a hanger such as shown in U.S. Pat. No. 2,874,726 or U.S. Pat. No. 2,645,251. However, the problem occurs that these type of devices are not readily convenient to utilize in releasing the heddle rod. Hanger devices which wrap around the heddle rod have been proposed which slide in and out of a groove fixed to or in the frame slat for release. However, as with all the above hanger devices, free movement of the heddles back and forth across the heddle rod is restricted.

Because the mobility of the heddles is restricted, the loom operator often does not take time to space them out evenly. The result is that the heddles become sectionalized on the heddle frame wherein more heddles than are needed are contained in certain sections of the heddle frame. The loom operators are reluctant to perform the work required to redistribute the heddles evenly and space them across the heddle frame. The uneven spacing of the heddles destroys the parallelism of the warp yarns extending from the warp beam to the reed of the loom. The uneven non-parallel relationship of the warp yarns results in gaps between the individual warp yarn ends which can create streaks in the fabric during weaving.

U.S. Pat. No. 4,088,158 discloses a heddle rod hanger assembly by which a heddle rod may be slidably attached to the heddle rod hook. However, the rod hook is fixed to a sleeve fixed to a slat and the heddle rod slides for assembly and disassembly. This results in a loose fit between the rod hook and heddle rod which is undesirable due to the loads imposed by the dynamics of machine operation.

SUMMARY OF THE INVENTION

Accordingly, an important object of the present invention is to provide apparatus for connecting a heddle rod to a frame slat of an associated heddle frame which provides quick release of the heddle rods for drawing-in of the warp yarn ends.

Another important object of the present invention is to provide apparatus for the quick connection and disconnection of a heddle rod and frame slat of an associated heddle frame yet which does not interfere with the mobility of the heddles supported on the heddle rods over the length thereof across the heddle frame.

Yet another important object of the present invention is to provide apparatus for connecting a heddle rod and frame slat of an associated heddle frame which includes a slidable connector sleeve which slides conveniently for releasing the heddle rod.

Still another important object of the present invention is to provide a quick release connection between a rod hook fixed to a heddle rod and a frame slat of an associated heddle frame in the form of a connector sleeve slidably carried continuously across the frame slat for sliding on and off the fixed rod hook.

Still another important object of the present invention is to provide a quick release slidable non-metallic connector sleeve for connecting a heddle rod and frame slat on an associated heddle frame which protects against metal-to-metal contact of adjacent heddle frames during shedding.

The above objectives are achieved by fixing a rod hook to a heddle rod which has a connecting shank which spaces the heddle rod away from the rod hook permitting free passage of the heddles thereover. There is a free end of the rod hook extending freely from the shank. A slidably connecting sleeve slides on the frame slat. There is a connecting portion on the free end of the rod hook on and off of which the connector sleeve slides for quick connection and disconnection. In one form, the connector sleeve is plastic and wraps entirely about the frame slat. The sleeves on adjacent heddle frames contact each other to prevent metal-to-metal contact of the heddle frame during shedding.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
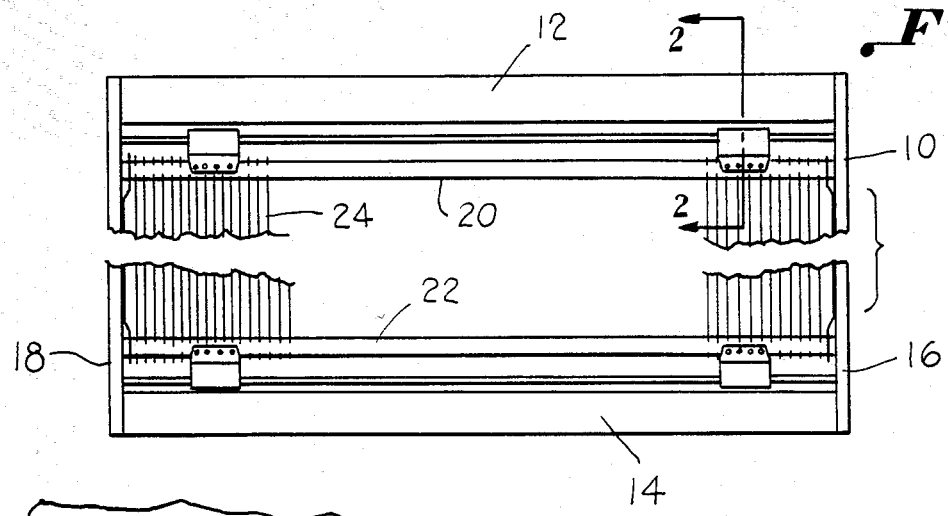
FIG. 1 is a front elevation illustrating a heddle frame incorporating apparatus for releasably connecting a heddle rod and frame slat on the heddle frame according to the present invention.
Figure 3:
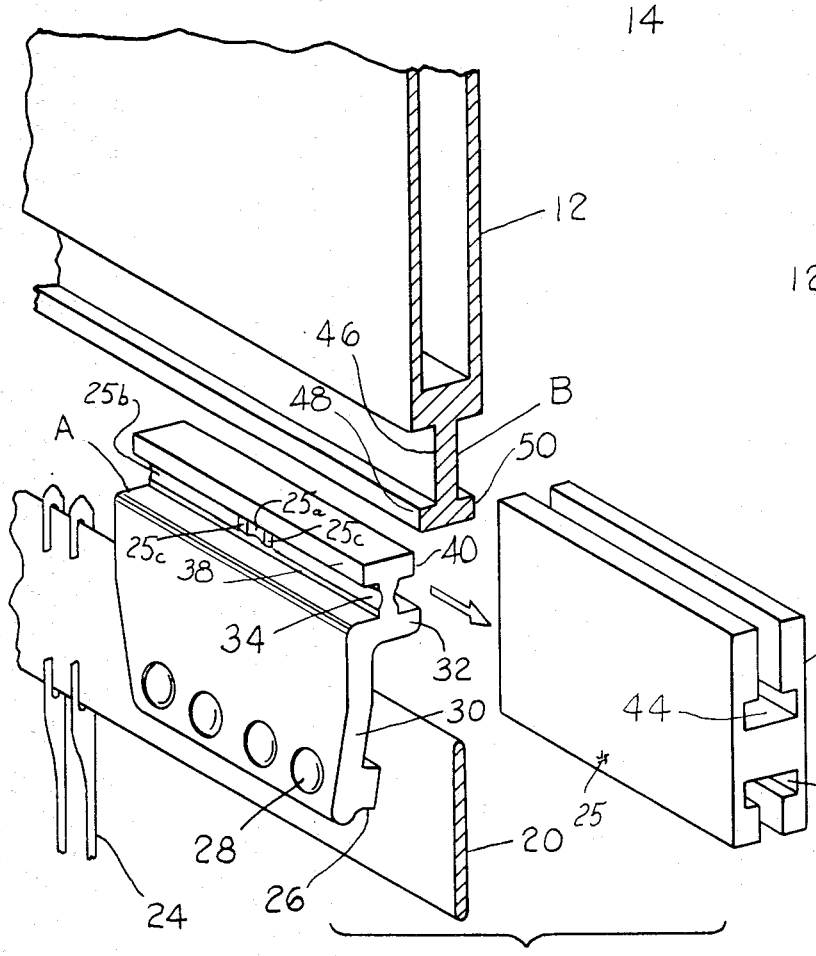
FIG. 3 is a perspective view with parts separated illustrating apparatus for releasably connecting a heddle frame slat and heddle rod according to the present invention.
Figure 2:
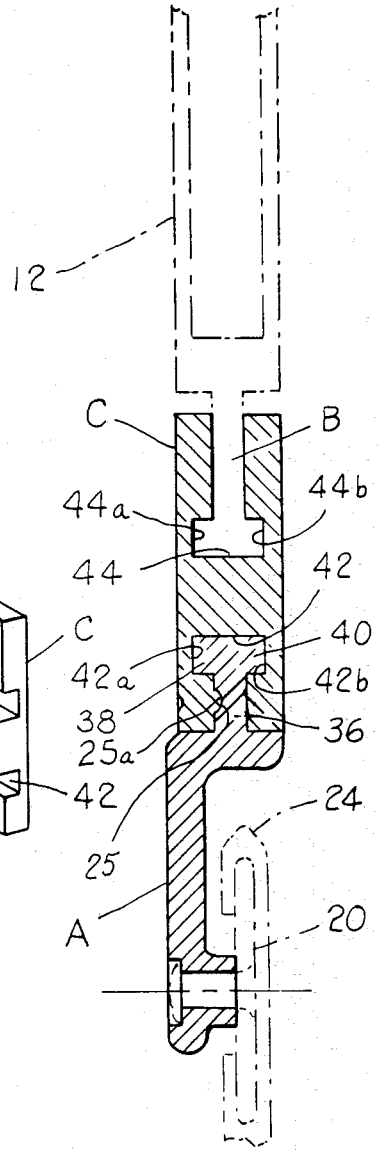
FIG. 2 is a sectional view taken along line 2—2 of FIG. 1.

Referring now in more detail to the drawings, a heddle frame is illustrated at 10 which includes an upper frame slat 12 and a lower frame slat 14. The frame slats are spaced apart by means of side frame members 16 and 18. Upper and lower heddle rods 20 and 22 are carried by the frame slats on which the individual heddles 24 are supported in the frame.

According to the present invention, apparatus for releasably connecting the heddle rod and the frame slat on both the top and bottom of the heddle frame is illustrated as including an affixed rod hook A and frame slat connector flange B which are releasably connected together by means of a slidable connecting sleeve C. As illustrated, the rod hook and connecting sleeve means C have virtually the same body width dimension while the connector flange B of the frame slat runs continuously across the frame slat.

Retaining means for locating and retaining the sleeve C and rod hook A together in a connecting position includes a protuberance 25 and a complementary pocket **25*a* in which the protuberance fits. As parts A and C (or D) slide together, the protuberance 25 slides in a groove 25*b* until it rides up an dover a ramp portion 25*c* and into the pocket between two adjacent ramps 25*c***. This retaining means also insures location of the sleeve fully on the rod hook.

The rod hook A is stationarily affixed to the heddle rod by means of a connecting shank 26 which is riveted to the heddle rod 20 by means of conventional rivets 28. The shank joins a web portion 30 and serves to space the heddle rod from the web 30 such that the individual heddles 24 having an essentially "C" shaped heddle rod slot may slide freely past the rod hook. In this manner, the heddles may be maintained evenly spaced across the heddle frame and not sectionalized thereon. The web 30 terminates in a horizontal flange 32 on which is formed an upstanding generally T-shaped freely extending flange portion 34. The free end flange 34 includes a web 36 and opposing horizontal flanges 38 and 40.

The slidable connecting means C includes a first generally T-shaped groove 42 for receiving free end flange portion 34 of the rod hook and a second inverted generally T-shaped groove 44. The second groove 44 corresponds with the shape of connector flange B of the frame slat which includes a stem 46, and opposed flanges 48, 50. Both grooves 42, 44 include side channels **42*a*, 42*b* and 44*a*, 44*b* which receive corresponding opposing horizontal flanges 38, 40 and 48, 50**.

With the rod hook A affixed to the heddle rod and the frame slat affixed to the heddle frame, the slidable connecting sleeve C may slide relative to the connecting flange B of the frame slat from a connecting position interlocked with free end flanges 34 of rod hook A to a release position where the sleeve is completely off the rod hook releasing it from the frame slat for removal of the heddle rod. The heddle rod hook does not bind the heddle rod so as to limit the mobility of the heddles 24 thereon.

Figure 4:
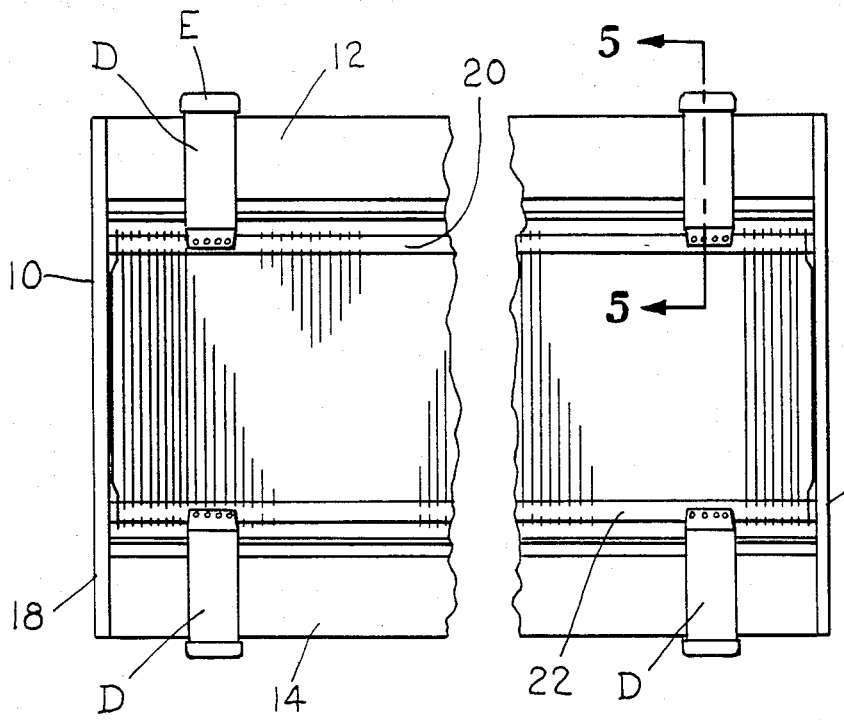
FIG. 4 is a front elevation illustrating another embodiment of apparatus for releasably connecting a frame slat and heddle rod on an associated heddle frame according to the present invention.
Figure 6:
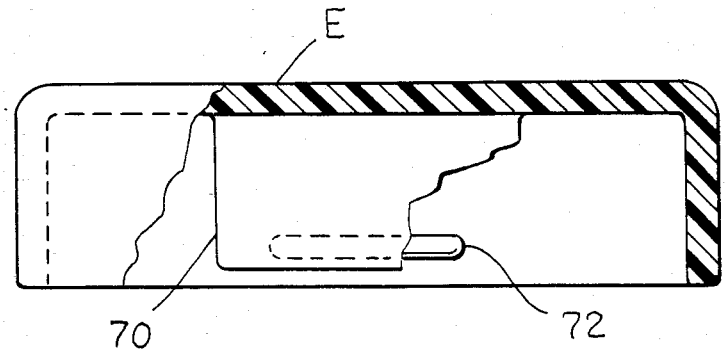
FIG. 6 is an elevation with parts cut away of a cap for securing together the ends of a connector sleeve wrapped about a frame slat according to the invention.
Figure 5:
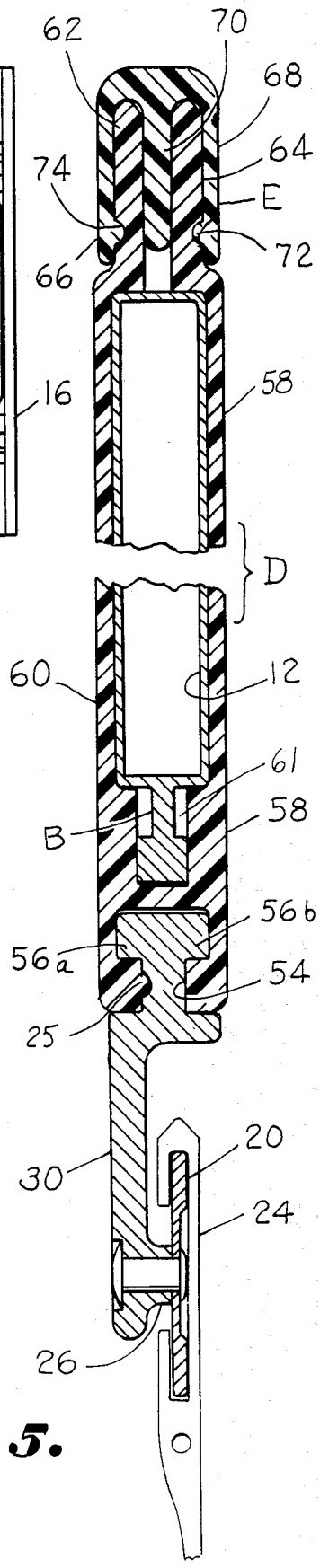
FIG. 5 is a sectional view taken along line 5—5 of FIG. 4.
Figure 7:
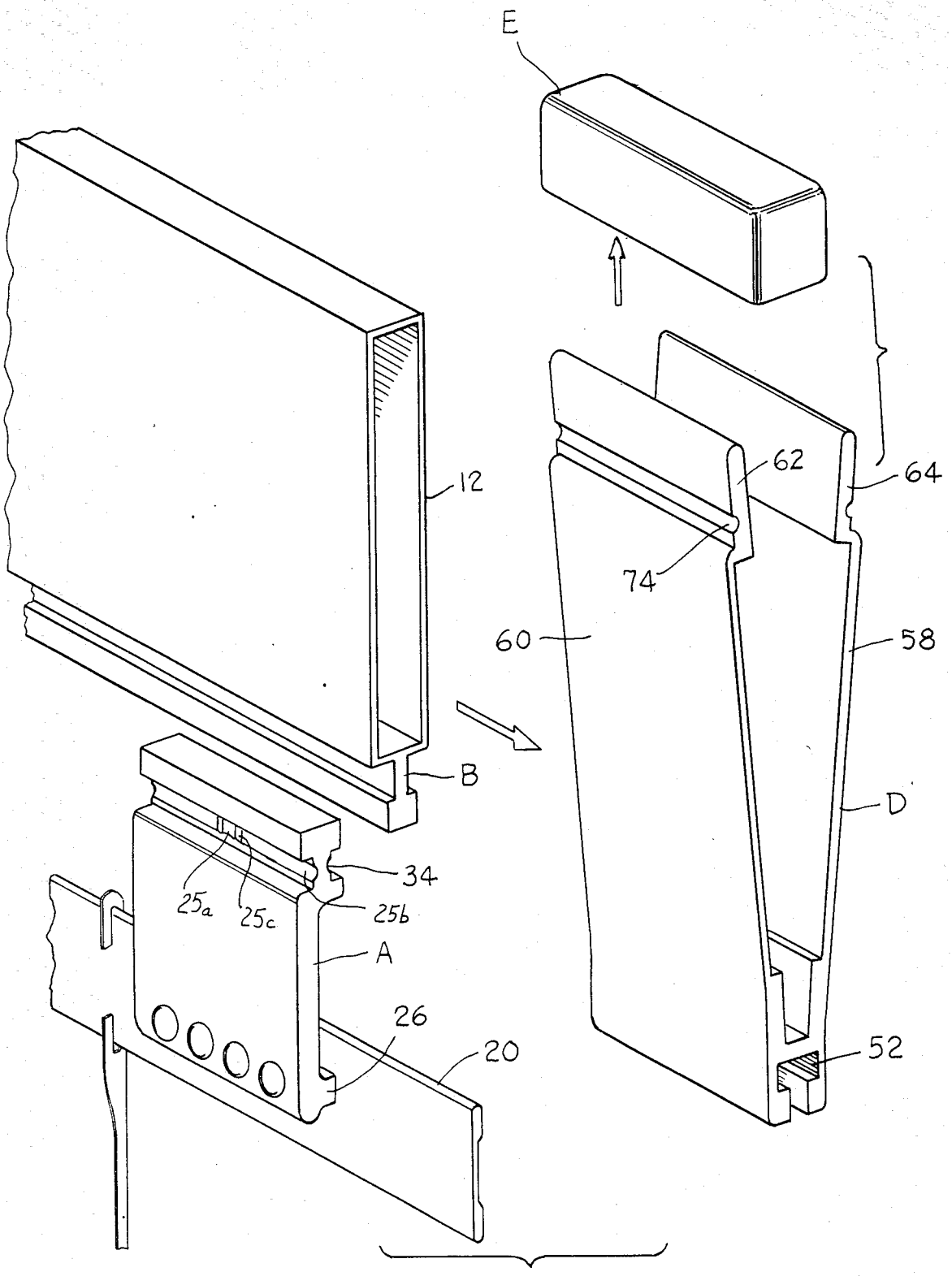
FIG. 7 is a perspective view with parts separated of apparatus for releasably connecting a heddle rod and frame slat of an associated frame according to the invention.

FIGS. 4 and 5 illustrate yet another embodiment of the invention wherein the slidable connecting sleeve is illustrated at D in the form of a sleeve which envelopes the entire side frame wherein the entire frame slat serves as the connecting portion thereof. The connecting sleeve in this instance includes a lower generally T-shaped open groove 52 defined by an opening 54 and opposing side channels **56*a* and 56*b*. The connecting sleeve D further includes a pair of spaced apart sides 58 and 60 which flex outwardly to receive the frame slat. An open top channel 61 is included in the sleeve D for receiving the flange B. The sides terminate in free ends 62 and 64**. Sleeve D may be constructed from any suitable plastic material such as nylon.

A cap means E fits over the free ends and includes prong means in the form of outer prongs 66 and 68 and intermediate prong 70 which fit over the free ends 62 and 64 clamping them together. An interlock means is provided in the form of a protuberance 72 formed in the sides of at least one of the prongs such as the outer prong as illustrated. The protuberance fits in a complimentary dimple formed in the mating surface of the free ends at 74 which provides a means for interlocking the cap and the free ends in a fixed clamped relationship during use.

The sides of the connecting sleeve member serves to hold adjacent aluminum frame slats on a parallel relationship along the length of the heddle frame. The encircling plastic side of a sleeve on one frame slat would guide against a matching plastic side on an adjacent sleeve and frame to effectively prevent the possibility of aluminum-to-aluminum clashing and resultant wear. If the sides of the sleeve wear thin, the sleeve can easily be replaced after unsnapping the cap and slipping the now open end of the sleeve over and away from the frame slat.

To remove the heddle rod, the assembled connecting sleeve D or C is slid along the frame slat away from the heddle rod hook A until the heddle rod is completely cleared. The heddle rod may then be removed from the frame along with the heddles for drawing-in of the warp threads.

While a preferred embodiment of the invention has been described using specific terms, such description is for illustrative purposes only, and it is to be understood that changes and variations may be made without departing from the spirit or scope of the following claims.

What is claimed is:

1. In a heddle frame for a loom of the type having upper and lower spaced frame slats connected by side frame members, heddle rods carried by said frame slats between which individual heddles are supported in said frame, apparatus for connecting said frame slat and said heddle rod comprising:

a fixed rod hook having a fixed shank portion stationarily affixed to said heddle rod and a free end flange portion extending freely away from said heddle rod in connectable alignment with said frame slat;

a connector portion carried by said frame slat;

slidable connecting sleeve means slidably carried on said connector portion of said frame slat for engaging said free end flange portion of said rod hook to releasably connect and disconnect said frame slat and said rod hook;

said connecting sleeve means sliding relative to said connector portion of said frame slat and said free end flange portion of said rod hook; and said connecting sleeve means interlocking with said free end flange portion of said heddle rod hook in a connecting position and sliding entirely off of said free end flange portion in a release position providing a quick assembly and disassembly of said heddle rod and frame slat of said heddle frame.

2. The apparatus of claim 1 wherein said connector portion of said frame slat includes a connector web extending downwardly therefrom and a pair of opposed connector flanges extending outwardly therefrom, said connecting sleeve means having a correspondingly shaped groove with side channels in which said opposed connector flanges are received and slide.

3. The apparatus of claim 2 wherein said connecting sleeve means includes a second groove having a shape corresponding to said free flange portion of said rod hook which is slidably received therein.

4. The apparatus of claim 1 wherein said connector sleeve means includes a sleeve encircling said frame slat, and said connector portion includes the outer periphery of said frame slat which is encircled by said connector sleeve means and over which said sleeve slides.

5. The apparatus of claim 4 wherein said sleeve includes a complimentary shaped groove open for reliably receiving and connecting said free end flange portion of said rod hook.

6. The apparatus of claim 5 including dimple means formed in a surface of one of said groove and free end flange portion and a complimentary protuberance formed on an opposing surface engaging within said dimple means positioning said connecting sleeve and rod hook in a fixed connecting position relative to each other.

7. The apparatus of claim 4 wherein said connecting sleeve includes a pair of spaced sides which receive said frame slat having free ends, said apparatus including cap means fitting over said free ends holding said free ends together and fixing said sleeve about said frame slat.

8. The apparatus of claim 7 wherein said cap means includes prong means which interfit between said free ends of said sides of said connecting sleeve and clamp the same together.

9. The apparatus of claim 8 wherein said prong means includes a pair of outer prongs and an intermediate prong fitting between said free ends whereby said free ends are clamped in a spaced apart position by said intermediate prong and said outer prongs.

10. The apparatus of claim 7 including interlock means interlocking said prong means and said free ends together.

11. In a heddle frame for a loom of the type having upper and lower spaced frame slats connected by side frame members, heddle rods carried by said frame slats between which individual heddles are supported in said frame, apparatus for connecting said frame slat and said heddle rod comprising:

a fixed rod hook having a fixed shank portion stationarily affixed to said heddle rod and a free end flange portion extending freely away from said heddle rod in connectable alignment with said frame slat;

an intermediate web portion connecting said free end flange portion and said fixed shank portion, said fixed shank portion projecting beyond said web portion to space said heddle rod from said web portion and facilitate free movement of said heddles across said heddle rod;

slidable sleeve means slidably carried by said frame slat for releasably connecting and disconnecting said frame slat and said rod hook;

said sleeve means sliding relative to said frame slat and having a connecting position in which said sleeve means is slid onto and interlocks with said free end flange portion of said heddle rod hook and a release position in which said sleeve means is slid entirely off of said free end flange portion providing quick assembly and disassembly between said heddle rod and frame slat of said heddle frame facilitating removal for drawing-in of warp yarn ends on said loom.

12. The apparatus of claim 11 wherein said frame slat includes a connector flange portion on which said sleeve means slides, said sleeve means including a groove having a shape corresponding to said free end flange portion of said rod hook which is slidably received therein.

13. The apparatus of claim 11 including retaining means locating and locking said sleeve means and rod hook together in said connecting position.

14. The apparatus of claim 11 wherein said sleeve means includes a wrap-around sleeve encasing said frame slat, said sleeve including slot means on one end which slidably interlocks with said free end flange portion of said rod hook, and said sleeve including plastic sidewalls for reducing metal-to-metal contact between adjacent heddle frames.

15. In a heddle frame for use on a loom with other similar heddle frames wherein said heddle frame is of the type having upper and lower spaced frame slats connected by side frame members, heddle rods carried by said frame slats between which individual heddles are supported in said frame, apparatus for connecting said frame slat and said heddle rod comprising:

a fixed rod hook having a fixed shank portion stationarily affixed to said heddle rod and a free end flange portion extending freely away from said heddle rod in connectable alignment with said frame slat;

sleeve means slidably carried on said frame slat adapted for connection to said free end flange portion of said rod hook;

said sleeve means including a pair of flexible spaced apart plastic sidewalls having a hollow space therebetween in which said frame slat is slidably received;

said sleeve means encasing said frame slat with said plastic sidewalls of said sleeve means for engaging with plastic sidewalls of sleeve means on adjacent frame slats of said other heddle frames on said loom to prevent metal-to-metal contact therebetween; and said sleeve means including slidable connecting means for sliding connection and disconnection with said free end flange portion of said rod hook.

* * * * *